United States Patent [19]

Cochran

[11] 3,974,372

[45] Aug. 10, 1976

[54] ORNAMENTAL LIGHTING STANDARD

[75] Inventor: Charles K. Cochran, Cornelius, Oreg.

[73] Assignee: The City of Portland, Portland, Oreg.

[22] Filed: Oct. 30, 1974

[21] Appl. No.: 519,094

[52] U.S. Cl. ..... 240/84; 52/98; 52/297; 52/731; 240/25; 248/159

[51] Int. Cl.[2] ..... F21V 21/00; F21V 25/00

[58] Field of Search ..... 240/25, 81 R, 84; 52/296, 297, 98, 99, 731; 248/159

[56] References Cited

UNITED STATES PATENTS

| | | | |
|---|---|---|---|
| 1,086,346 | 2/1914 | Barrick | 240/84 X |
| 1,133,266 | 3/1915 | Collier | 240/25 |
| 1,499,445 | 7/1924 | Clay | 52/98 |
| 1,660,908 | 2/1928 | Barkschat | 240/84 |
| 1,712,757 | 5/1929 | Erskine | 240/84 X |
| 1,776,682 | 9/1930 | King | 240/84 |
| 1,903,907 | 4/1933 | Riemenschneider | 240/84 X |
| 1,906,508 | 5/1933 | Arbogart | 240/84 X |
| 2,117,862 | 5/1938 | Steinmayer et al. | 240/25 |

*Primary Examiner*—Joseph F. Peters, Jr.
*Attorney, Agent, or Firm*—Eugene M. Eckelman

[57] ABSTRACT

A plurality of ornamental lighting standard shell parts are stacked one upon the other around a ground anchored inner pole. The shell includes a base portion enlarged relative to an adjacent portion of the pole and is capable of shifting laterally a slight amount in the event that it is struck by a vehicle. An intermediate portion of the shell is constructed of a plurality of replaceable parts for easy installation and replacement. The shell also includes ornamental parts as well as lamp assemblies.

3 Claims, 5 Drawing Figures

FIG. 1A
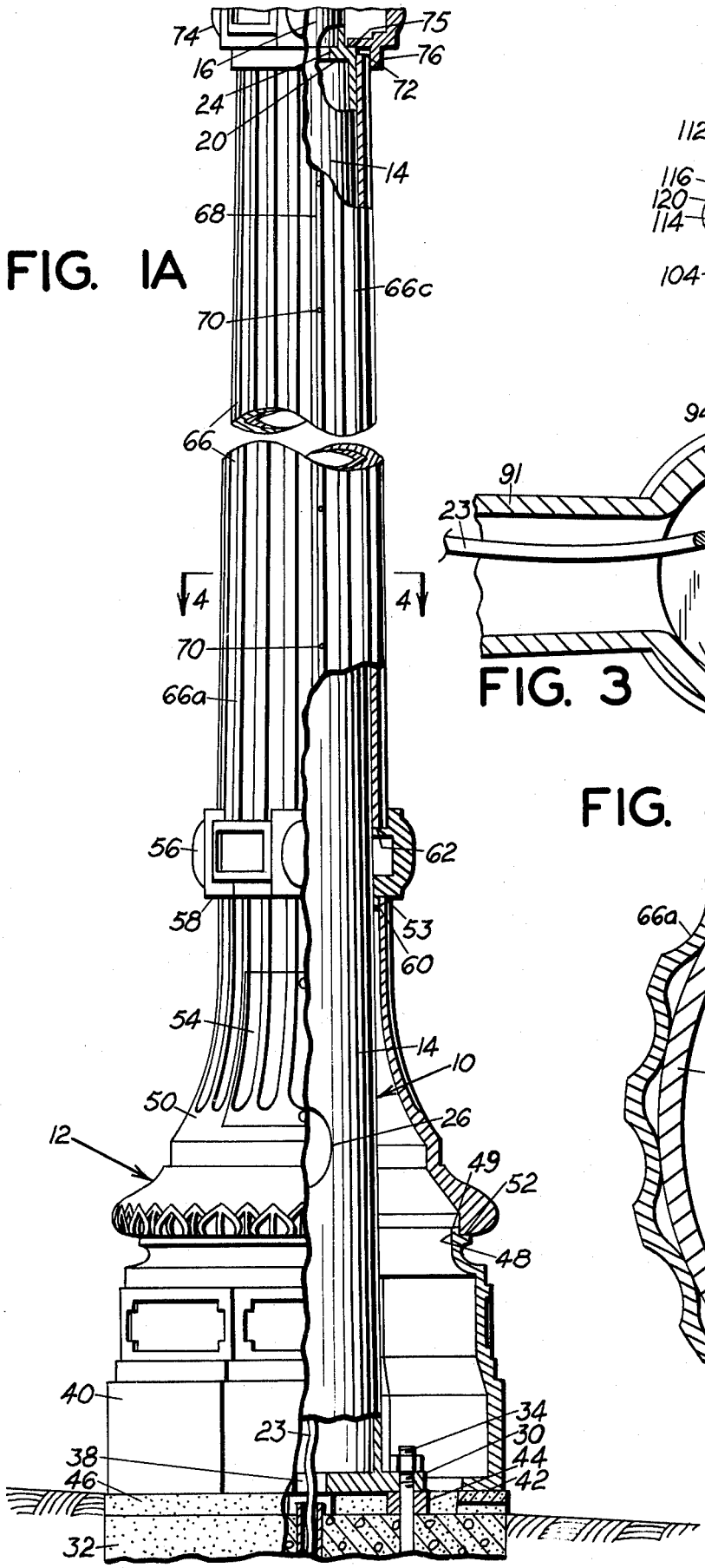
FIG. 2
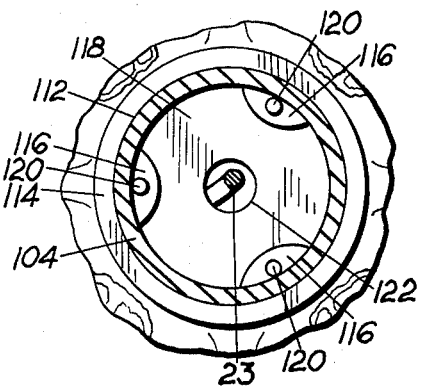
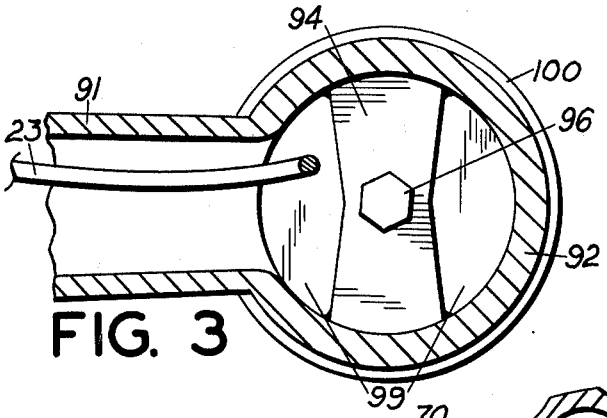
FIG. 3
FIG. 4
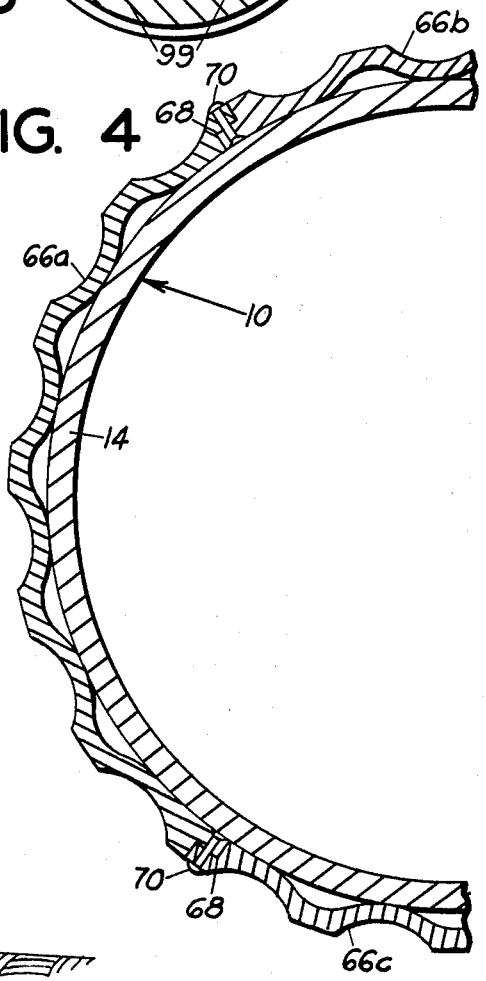

ORNAMENTAL LIGHTING STANDARD

BACKGROUND OF THE INVENTION

This invention relates to new and useful improvements in lighting standards and is more particularly concerned with an ornamental lighting standard.

The trend in lighting standards on city streets has been to the more simple or plain appearance because of the expense of constructing, installing and maintaining the more decorative type. That is, the more decorative type of lighting standards are more expensive in their casting and consequently when damaged, or otherwise require replacement, are more expensive to replace. Thus, the beautification of lighting standards on city streets is being abandoned due to economics.

SUMMARY OF THE INVENTION

According to the present invention and forming a primary objective thereof, a lighting standard is provided which, while being ornamental, embodies certain features that allow its cost to be reduced in construction, installation and maintenance, thus warranting the general use thereof.

A more particular object of the present invention is to provide an ornamental lighting standard assembly employing an inner or central pole anchored firmly to the ground and enclosed in an outer shell of easily replaceable ornamental parts which are stacked one upon another and which include lamp assemblies.

Another object of the invention is to provide an ornamental lighting standard of the type described employing in such outer shell a base part that is capable of shifting laterally a slight amount to reduce its possibility of being broken in the event that it is struck by an automobile.

Another object is to provide an ornamental lighting standard of the type described also utilizing in such outer shell an intermediate portion constructed of a plurality of longitudinal replaceable parts for easy installation and replacement, such intermediate portion preferably being constructed of fiberglass or the like and being fluted for ornamentation.

The invention will be better understood and additional objects and advantages will become apparent from the following description illustrating a preferred form of the device.

BRIEF DESCRIPTION OF THE DRAWINGS

FIGS. 1A and 1B are elevational views, partly broken away, of lower and upper portions, respectively, of a lighting standard embodying the instant invention, the portion shown in FIG. 1A being foreshortened;

FIG. 2 is an enlarged sectional view taken on the line 2—2 of FIG. 1B;

FIG. 3 is an enlarged sectional view taken on the line 3—3 of FIG. 1B; and FIG. 4 is an enlarged fragmentary sectional view taken on the line 4—4 of FIG. 1A.

DETAILED DESCRIPTION OF A PREFERRED EMBODIMENT

Figure 1B:
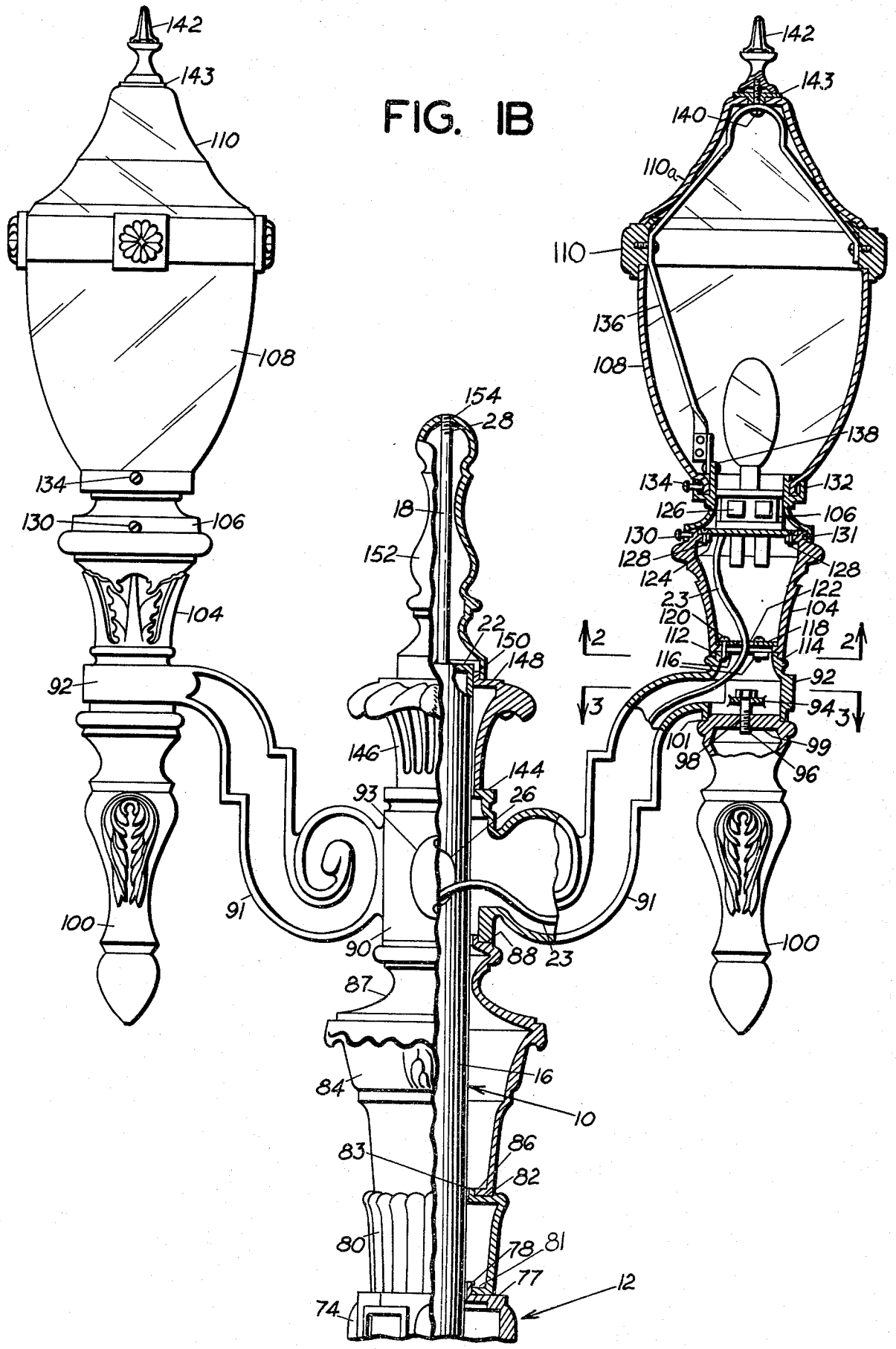

The invention comprises two principal parts, namely, a ground anchored inner pole or post 10 and an outer shell 12 including upper lamp assemblies. These two principal parts are shown in the combination of FIGS. 1A and 1B. The inner pole 10 consists of a lower main body portion 14, FIG. 1A, preferably tapered to a smaller dimension toward the top. Body portion 14 has a uniform diameter, vertical extension 16, FIGS. 1A and 1B, of smaller dimension than the top of the body portion. A rod 18, FIG. 1B, extends upwardly in integral relation from the extension 16. For the purpose of providing an integrated structure, the upper end of body portion 14 has a wall 20 to which the extension 16 is secured, as by welding, and the extension 16 has a top wall 22 to which the rod 18 is secured. The two portions 14 and 16 are tubular in construction for receiving suitable wiring 23, and wall 20 has an opening 24 through which the wiring can extend. These body portions also have appropriate upper and lower hand holes 26 for operator access. The top end 28 of rod 18 is threaded for a purpose to be described.

The bottom end of the body portion 14 has an integral base plate 30 arranged to seat on a footing 32 in the ground and be secured to such footing by bolted connection to studs 34 projecting from such footing. The wiring 23 extends up through the footing for entry into the pole, the base plate 30 having a suitable opening 38 through which the wires can extend.

The inner pole 10 thus is seen to comprise a rigid, permanent support and encloses all the necessary wiring up to lamp assemblies, to be described.

The outer decorative and lamp supporting shell 12 has a first part comprising a tubular base member 40 provided with a flat bottom edge 42 adapted for seating engagement on a sidewalk or other supporting surface. This base member is leveled by suitable shims 44, and grouting material 46 having suitable water drain holes is filled in any space that may be present between the bottom of base member 40 and the sidewalk.

The top of base member 40 comprises a flat annular edge 48, and a short annular tongue 49 projects upwardly from such edge at the inside of the latter. Base member 40 is decorative on its outer surface.

Adapted to be seated on the base member 40 is a tubular part 50 having a bottom annular edge 52 adapted to seat on the top edge 48 of base member 40, the tongue 49 projecting up into the part 50 to provide lateral support. While tongue 49 serves to center the two members 40 and 50, it is at the same time short enough such that base member 40 can move laterally a slight amount without breaking the tongue or the upper end of said base member in the event that the latter is struck by a vehicle, as will be more fully described hereinafter. The part 50 terminates at its top in a flat annular edge 53. A door 54 is provided in a side wall of the intermediate part 50 for access to the interior of the shell, such door being in the area of a hand hole 26. The outer surface of part 50 is decorative.

Seated on top of the intermediate part 50 is a decorative ring 56 having a bottom edge 58 adapted for seating engagement on the top edge 53 of part 50. Ring 56 has a depending tongue 60 which fits down into the part 50. The upper end of part 56 has a flat annular edge 62.

Seated on top of the ring 56 is an elongated part or body portion 66 of the shell. This part is tubular in construction, and the bottom end seats on the upper edge 62 of part 56. Part 66 is fluted for ornamentation and is constructed of two or more longitudinal segments, FIG. 4, preferably three. These segments are designated by the numerals **66*a*, 66*b*, and 66*c* in FIG. 4 and have overlapping longitudinal edges 68 connected together by pop rivets 70. It is preferred that the segments 66*a*, 66*b* and 66*c* be molded of fiberglass or other suitable plastic. The part 66 is tapered slightly to a smaller dimension toward the upper end thereof similar to body portion 14 of the pole 10, and in a preferred arrangement it is dimensioned to have a snug fit on portion 14 of the pole so that it cannot be turned by vandals. The top edge 72 of elongated shell part 66** is flat.

A decorative ring 74, FIGS. 1A and 1B, has an inturned bottom flange 75 surrounded by an outer depending annular tongue 76, the said tongue 76 being of a diameter slightly greater than the outside of the elongated part 66 at the top so as to fit over a portion of said part with the flange 75 seated on top of the pole portion 14. The ring 74 has a flat top 77 adjacent its outer edge and an upwardly directed annular tongue 78 at an inner termination of the top defining a central top opening.

A decorative shell part 80 seats on the top of ring 74 around pole portion 16 and for this purpose it has a bottom inturned flange 81 with a flat bottom surface adapted to seat on surface 77 of ring 74. Part 80 has an outer annular flat top portion 82 and an inner upwardly directed tongue 83 defining a central opening at its inner edge. Another decorative part 84 seats on part 80 and for this purpose it has an inturned flange 86 having a flat bottom surface adapted to seat on the top surface 82 of part 80. An upper portion 87 of part 84 is curved inwardly to a diameter only slightly greater than the adjacent diameter of post portion 16 so as to have lateral stability on the latter, and in this regard this same part at the bottom thereof also has lateral stability on the post portion 16 by suitable dimensioning of the opening defined by tongue 83. Likewise, parts 80 and 74 have lateral stability on the post by selected dimensioning of the central openings therethrough. Shell part 84 has a flat top surface 88 terminating at an inner point in an upwardly extending tongue defining a central opening only slightly larger in diameter than the post 16. A tubular lamp bracket 90 seats on the top surface 88 of part 84 and has a pair of oppositely extending hollow bracket arms 91 with vertically apertured support ends 92. Bracket 90 also has removable side plates 93 in the area of upper hand hole 26 for interior access. With reference to FIGS. 1B and 3, support ends 92 have a lateral horizontal web 94 provided with a depending stud bolt 96 arranged for threaded engagement with a tapped bore 98 in a top upper horizontal wall 99 of a depending decorative part 100. Wall 99 has an outer annular recess 101 dimensioned to receive the bottom edge of support end 92 for central mounting disposition.

Seated on each support end 92 is a lamp assembly comprising a decorative part 104, a ballast housing 106, a bowl glass 108, and a cover 110.

With particular reference to FIGS. 1B and 2, the upper portion of each support end 92 has an annular recess 112 and the lower end of its decorative part 104 has a bottom edge 114 adapted to seat on the shoulder formed by the recess. Support ends 92 have inturned apertured ears 116 at the top thereof and the decorative part 104 has a transverse wall 118 adjacent to the bottom thereof. Wall 118 has apertures aligned with the apertures in ears 116, and bolts 120 mounted in these apertures securely fasten the parts 104 to the bracket arms for upright support. Wall 118 has a central aperture 122 for receiving wiring 23.

The upper end of part 104 has an inturned flange 124 to which the ballast 126 is secured, as by screws 128. The bottom end of ballast housing 106 is flared out to fit over a portion of part 104 and is removably secured thereto by setscrews 130 engageable in a peripheral slot 131 in the part 104. The top of ballast housing 106 has an upwardly projecting annular flange 132 for laterally receiving screws 134 adapted to lock the bowl glass 108 removably in place in the usual manner. The cover 110 is removably held in place by a bracket arm 136 secured at its lower end to an upwardly directed ear 138 on the ballast housing and removably secured interiorly to the bottom and top portions of the cover by screws 140. A top one of the screws 140 projects upwardly beyond the cover and has threaded engagement with a top ornament 142 through a resilient washer 143. Cover 110 has a removable canopy glass portion **110*a* that is capable of easy removal for access to the interior of the bowl glass 108 by removal of top ornament 142**.

The top end 144 of lamp bracket 90 is flat, and a decorative part 146 which receives the top end of pole portion 16 seats on top of such bracket. Part 146 has an internal diameter at the lower end just slightly larger than the pole portion 16 for lateral stability and also has a flat top surface 148 terminating at an inner point in an upwardly extending tongue 150 defining a central opening adapted to receive the top end of post portion 16 in a rather close fit. A top ornament 152, open at the bottom but closed at the top, seats on the top 148 of part 146. This top ornament serves to clamp upper portions of the shell parts down as will be described more fully hereinafter, and for this purpose it has a tapped bore 154 in its top closed portion arranged for threaded engagement with the upper end 28 of rod 18.

For installing a lighting standard of the invention, the post member 10 is first securely anchored in place on the footing 32. The various parts of the shell are then moved down over the post member 10, starting with the lowermost member 40 and progressively stacking the parts one on the other. When the parts have been placed in position up through and including the part 146, the top ornament 152 is threadedly engaged with the rod 18. Such top ornament holds the parts 74, 80, 84, 90, and 146 firmly down against the top of pole portion 14.

The present invention thus provides a lighting standard which is ornamental in appearance and in view of its construction is relatively inexpensive to manufacture. Also, since the shell 12 is formed of a considerable number of parts, individual ones of such parts can be replaced if they are damaged or otherwise require replacement. Base member 40 is the part most apt to be hit by vehicles such as when vehicles are moving into parking spaces adjacent to the sidewalk, and in most instances, this member will not be damaged since it can move laterally a short distance away from its centered position under the parts thereabove. In such movement, the tongue portion on the top thereof will slide out from under the bottom of part 50. Such is the result of a slight amount of slack between the parts that is usually present from three bottom parts 40, 50, and 66. Therefore, in most instances, base member 40 when struck by an automobile will merely have to be re-centered rather than replaced. Body member 66 also comprises an area of the shell that may be damaged, as by trucks or buses, and to repair this portion of the standard, it is merely necessary to take out the damaged segment **66*a*, 66*b*, or 66*c*** by drilling out the necessary rivets and installing a new segment.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A lighting standard comprising a. a center pole, b. means at the lower end of said center pole arranged to anchor it securely to a base surface in upright relation, c. means at an upper portion of said center pole defining a support surface, d. a separate outer ornamental shell encompassing said pole, e. said shell comprising a tubular base member arranged to seat freely on the ground around said center pole, f. said shell further comprising a body member portion seated freely on said base member around said center pole, g. said base member being laterally shiftable relative to said body member while still providing support for the latter, h. a lamp supporting bracket removably supported on said support surface of the center pole and having at least one lamp assembly thereon, i. and hold-down means integral with the upper end of said pole holding said lamp supporting bracket down on said support surface, j. said tubular base member being substantially larger in diameter than the portion of the center pole passing through it whereby said tubular base member can have said lateral shifting movement in the event it is struck by a vehicle to reduce the possibility of breakage of said base member.

2. The lighting standard of claim 1 wherein said tubular base member and said body member portion of said ornamental shell have interfitting engagement, said elongated body member portion having vertical movement on said center pole whereby the said tubular base member can disengage from its interfitting engagement with said elongated body member by vertical movement of the latter and shift laterally when struck by a vehicle.

3. A lighting standard comprising a. a center pole, b. means at the lower end of said center pole arranged to anchor it securely to the ground in upright relation;

c. a separate outer ornamental shell encompassing said center pole, d. said shell comprising a tubular base member arranged removably to seat on the ground, e. said shell further comprising an elongated body member portion removably supported on said base member, f. said elongated body member being molded of glass fiber in a plurality of arcuate segmental replaceable parts and having a snug fit on said center pole to restrict rotation, g. a lamp supporting bracket removably supported on said center pole and having at least one lamp assembly thereon, h. and hold-down means integral with the upper end of said center pole holding said lamp supporting bracket down, i. said tubular base member being substantially larger in diameter than the portion of the center pole passing through it so that it can shift laterally to prevent breakage thereof in the event it is struck by a vehicle.

* * * * *